United States Patent [19]

Fujii

[11] 4,213,607

[45] Jul. 22, 1980

[54] METHOD AND STRUCTURE FOR PREVENTING REMOVAL OF GRIP COVERS FROM METALLIC BATS

[76] Inventor: Hirokazu Fujii, No. 19-9, 2-chome, Obiraki, Fukushima-ku, Osaka, Japan

[21] Appl. No.: 905,280

[22] Filed: May 10, 1978

Related U.S. Application Data

[63] Continuation-in-part of Ser. No. 620,215, Oct. 6, 1975, Pat. No. 4,090,709.

[30] Foreign Application Priority Data

Jan. 11, 1978 [JP] Japan ..... 53-2201

[51] Int. Cl.[2] ..... A63B 59/06; B21D 39/00; B23P 11/00

[52] U.S. Cl. ..... 273/72 A; 29/505; 29/509; 29/522 R; 29/526 R; 403/379

[58] Field of Search ..... 29/526 R, 505, 509, 29/522 R; 403/379; 273/72 A, 73 J

[56] References Cited

U.S. PATENT DOCUMENTS

| | | | |
|---|---|---|---|
| 686,311 | 11/1901 | Leaycraft | 403/379 X |
| 909,247 | 1/1909 | Spry | 403/379 |
| 4,000,895 | 1/1977 | Scatt et al. | 273/72 A |

FOREIGN PATENT DOCUMENTS

| | | | |
|---|---|---|---|
| 1473295 | 2/1967 | France | 273/72 A |

*Primary Examiner*—Charlie T. Moon
*Attorney, Agent, or Firm*—Browdy and Neimark

[57] ABSTRACT

A grip of a metallic bat is covered with a grip cover made of hard rubber and at least one pin or cotter is forced to penetrate through the grip cover and the grip in order to eliminate the possibility that the bat may fly out from the grip cover upon use. To prevent the pin from falling out, it is physically deformed after insertion, preferably from the inside of the bat.

3 Claims, 6 Drawing Figures

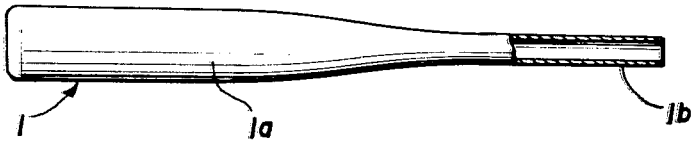
FIG. 1
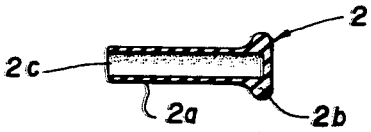
FIG. 2
FIG. 3
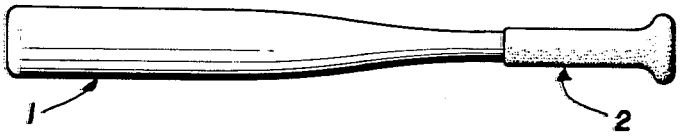
FIG. 4
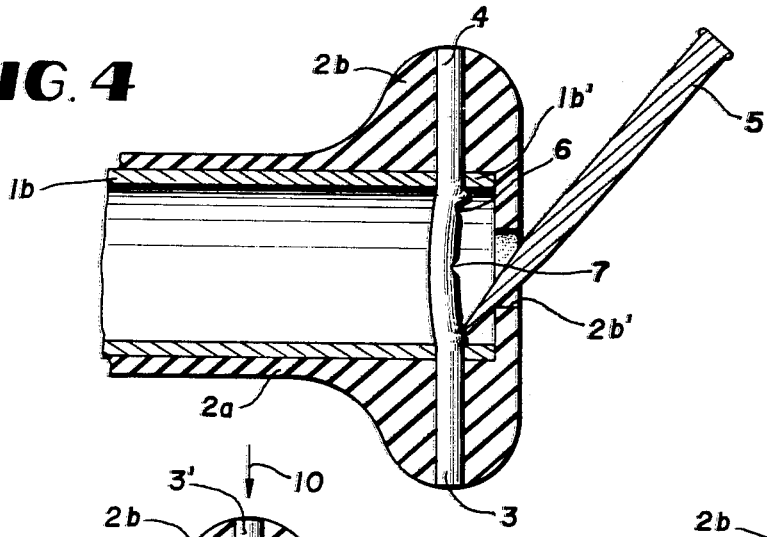
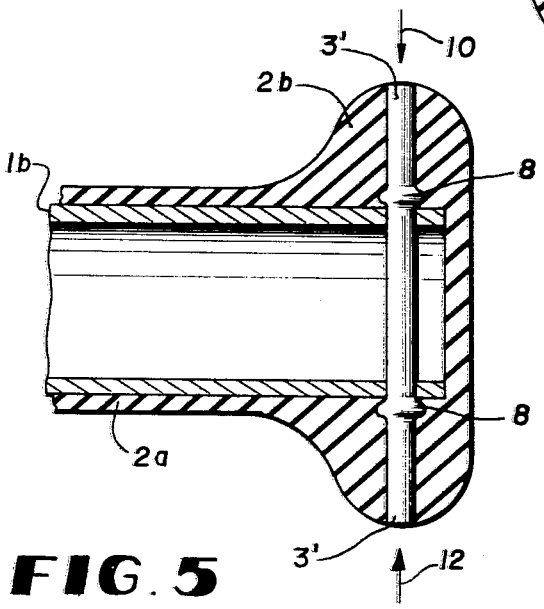
FIG. 5
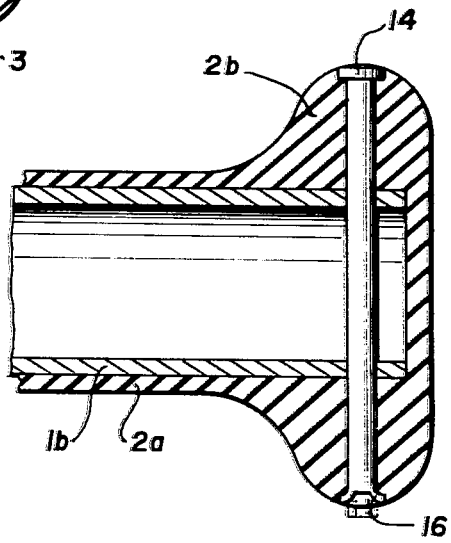
FIG. 6

METHOD AND STRUCTURE FOR PREVENTING REMOVAL OF GRIP COVERS FROM METALLIC BATS

CROSS-REFERENCE TO RELATED APPLICATIONS

The present application is a continuation-in-part of U.S. application Ser. No. 620,215 filed Oct. 6, 1975, now U.S. Pat. No. 4,090,709, issued May 23, 1978, the entire contents of which are hereby incorporated by reference.

FIELD OF THE INVENTION

The present invention relates to metallic bats which have been widely used increasingly in baseball, and more particularly, to a means by which the integrity of the grip cover with the bat is maintained.

BACKGROUND OF THE INVENTION

Metallic bats have lately been used as a substitute for wooden bats in baseball, particularly because of their durability. These metallic bats are conventionally made of aluminum or light alloys such as juralman. Metallic bats are hollow throughout their total length and are lighter and much stronger than wooden bats.

In the terminology of baseball bats, the portion which is grasped by the hands is known as the grip, the end of the grip which is ellipsoid-shaped to prevent the hands from slipping is known as the grip end, and the opposite end of the bat is known as the head. These definitions apply to the use of these terms throughout the present specification and claims.

In metallic bats, grip covers are conventionally used composed of a grip cover portion which covers the grip for preventing slipping and a grip end. The grip cover is integrally molded with hard rubber, and is adhered to the surface of the grip with adhesives.

As the grip cover is only adhered to the grip with adhesives, the grip is apt to be removed and to fly out from the grip cover to cause unforeseen accidents on swinging the bat. This trouble has become a problem in baseball.

SUMMARY OF THE INVENTION

Accordingly, it is an object of the present invention to avoid such disadvantages encountered by the prior art and to provide a metallic bat on which the grip cover is prevented from being removed from the grip. This is accomplished by forcing a pin or cotter through the grip end portion of the grip cover and through the underlying metal bat, and then physically deforming the pin or cotter in order to prevent its removal.

BRIEF DESCRIPTION OF THE DRAWINGS

FIG. 1 is an elevation, partly in section, of a metallic bat body;

FIG. 2 is a sectional view of a grip cover;

FIG. 3 is an elevation of the metallic bat as assembled with the grip cover;

FIG. 4 is a sectional view of the grip cover attached to the grip with the cotter pin being calked to the interior of the metallic bat by a calking tool;

FIG. 5 is a sectional view of the grip cover attached to the grip showing an alternative embodiment of deformation of the pin; and FIG. 6 is a sectional view of the grip cover, attached to the grip, showing still another alternative embodiment of the deformation of the pin.

DETAILED DESCRIPTION OF PREFERRED EMBODIMENTS

Referring to the drawings, numeral 1 is a hollow tubular bat body, which is conventionally made of aluminum or juralman, depending on the balls to be used. Numeral 1*a* represents the head and numeral 1*b* the grip. The end of the grip 1*b* is only cut off without working.

The grip cover 2, as illustrated in FIG. 2, consists of a grip cover portion 2*a* having an inside diameter of sufficient magnitude to insert the grip 1*b* of the metallic bat body into the inner part 2*c*, and having an approximately ellipsoid-shaped grip end 2*b* provided at the end of the cover 2*a*. The grip cover 2 is integrally molded with rubber. The grip cover 2 covers the grip 1*b* as illustrated in FIG. 3.

In the bat on which the grip 1*b* of the bat body 1 is inserted into the grip cover 2 by applying suitable adhesives, as illustrated in FIG. 4, numeral 3 represents a pin or cotter penetrated through the end 1*b*′ of the grip 1*b*, and the grip end 2*b* of the grip cover 2 so as to form a T-shape vertical to the axis of the grip 1*b*.

The process by which the bat is assembled comprises placing the grip end 2*b* onto the end 1*b*′ of the grip 1*b*, drilling a penetrating hole 4 through the grip end 2*b* and the end 1*b*′ of the metal grip, and then pressing the pin into the penetrating hole 4.

A hole 2*b*′, having a suitable diameter to insert a tool to be used for a physical deformation of the pin or cotter, such as a calking tool 5, is drilled on the end surface of the grip end 2*b*. The pin 3 may then be physically deformed at a place adjacent to the inner wall of the grip 1*b* to prevent removal such as for instance by calking by means of a calking tool (chisel 5 as shown in FIG. 4. The deformations 6 adjacent the inner wall of the grip 1*b* clearly prevent removal of the pin once it has been placed and, in fact, cause the pin to become attached to the inner wall of the grip. Preferably, the pin may also be deformed in the center as shown at 7 in FIG. 4 by striking the center of the pin with the end of the chisel 5 which extends through the hole 2*b*′ in the end of the grip cover 2. While it is preferred that both deformations 6 and 7 be made, it is clear that deformations solely at the locations adjacent the inner wall of the grip without the center deformation 7 may be used, or alternatively, the center deformation 7 may be used exclusively without the deformations 6 adjacent the inner wall of the grip 1*b*. In either case, the deformation of the pin will prevent its removal.

FIGS. 5 and 6 show alternate methods of deformation of the pin to prevent its removal. In FIG. 5, the pin is annealled only at the portions 8 prior to to inserting it through the grip end and the metallic tube. This annealling causes a weakening of the pin in these spots. After the pin is inserted, the tip ends 3′ of the pin 3 are struck in the direction indicated by arrows 10 and 12 in order to cause deformation of the pin 3 in the areas 8 which are adjacent the outside wall of the grip 1*b*. In this case, there need be no hole made in the end of the grip cover 2.

In FIG. 6, the pin 3 is formed with a head 14 and a tubular foot 16 (shown prior to deformation by the dotted line). The foot 16 may then be calked to deform it into the flower-like shape as illustrated in FIG. 6.

By physically deforming the pin by any of the methods set forth hereinabove, the metallic bat of the present invention avoids the disadvantages of conventional metal bats in that the grip is prone to fly out of the grip cover to cause unforeseen accidents on swinging the bat. Thus, it is possible to provide a safe and functional metallic bat.

It will be obvious to those skilled in the art that various changes may be made without departing from the scope of the invention and the invention is not to be considered limited to what is shown in the drawings and described in the specification.

I claim:

1. In a hollow tubular metallic bat having a grip cover made of hard rubber or the like covering the grip of the bat, said grip cover having an enlarged grip end, the improvement whereby the grip of the bat is prevented from flying out of the grip cover upon swinging of the bat, comprising:

at least one pin or cotter penetrating through said grip end of said grip cover and said grip, said pin being physically deformed at the center thereof between the inside wall portions of said grip, the portion of the pin between the inside wall portions of said grip thus being bent to prevent removal of the pin, and said pin being further deformed, to further prevent removal of the pin, by calking to the inside wall of said grip.

2. A bat in accordance with claim 1 wherein said grip cover has a hole therein in the extreme end thereof covering the open end of said grip, for allowing physical deformation of said pin or cotter in the portion thereof between the inside walls of said grip.

3. A process for producing a metallic bat in accordance with claim 1, comprising:

covering the grip of the bat with a grip cover made of hard rubber or the like and having an enlarged grip end;

drilling a hole through the grip end of the grip cover and the metallic grip of the bat therebeneath;

placing a pin or cotter in said hole thus penetrating the grip end and the grip; and physically deforming the pin or the cotter by deforming the pin at the center thereof between the inside wall portions of the grip, the portion of the pin between the inside wall portions of the grip thus being bent to prevent removal of the pin through said hole, and further deforming the pin, to further prevent removal thereof, by calking the pin to the inside wall of the grip.

* * * * *